US005504956A

United States Patent [19]

Wiedeck et al.

[11] Patent Number: 5,504,956

[45] Date of Patent: Apr. 9, 1996

[54] GUIDE GROOVE AT BRIDGE SECTIONS OR THE LIKE OF PORTABLE BRIDGES AND METHOD FOR REPAIRING THE SAME

[75] Inventors: Hans-Norbert Wiedeck, Mülheim; Jürgen Brandenbusch, Straelen, both of Germany

[73] Assignee: Fördertechnik GmbH, Duisburg, Germany

[21] Appl. No.: 310,982

[22] Filed: Sep. 23, 1994

[51] Int. Cl.[6] ..... E01D 15/133

[52] U.S. Cl. ..... 14/2.4; 14/2.5

[58] Field of Search ..... 14/2.4, 2.5, 2.6, 14/72.5

[56] References Cited

U.S. PATENT DOCUMENTS

| | | | |
|---|---|---|---|
| 5,042,102 | 8/1991 | Kahmann et al. | 14/2.4 |
| 5,063,630 | 11/1991 | Wiedeck | 14/2.4 |
| 5,179,751 | 1/1993 | Wiedeck | 14/2.4 |

FOREIGN PATENT DOCUMENTS

| | | | |
|---|---|---|---|
| 1658623 | 10/1975 | Germany . | |
| 3138853 | 4/1983 | Germany . | |
| 3719508 | 12/1988 | Germany | 14/2.5 |
| 3911266 | 10/1990 | Germany . | |
| 3914441 | 11/1990 | Germany . | |
| 4022641 | 1/1992 | Germany . | |
| 4123092 | 1/1993 | Germany . | |

*Primary Examiner*—Ramon S. Britts
*Assistant Examiner*—James A. Lisehora
*Attorney, Agent, or Firm*—Spencer & Frank

[57] ABSTRACT

A guide groove provided in an inner lower cord of a bridge section of a portable bridge includes an extruded profile section which is comprised of a vertical strip having an upper end and a lower end, and being composed of, over its entire height in at least a partial cross section thereof, a homogeneous material; and an upper wall section extending from the upper end of the vertical strip and a lower wall section extending from the lower end of the vertical strip. The guide groove has an increased service life when the vertical strip has a thickness in cross section which is reduced at the center portion of the bridge section over at least a part of the length of the bridge section in respect to at least one of the end portions of the bridge section. The guide groove is repairable by a method in which an insertion element is replaced, the insertion element being provided over a part of the length of the bridge section in which the thickness in cross section of the vertical strip is not reduced. The insertion element has an L-shaped profile including a horizontal leg which forms the lower wall section and a vertical leg which forms a part of the vertical strip, which vertical leg can be releasably fastened on the vertical strip, and wherein the vertical strip and the vertical leg of the insertion element have corresponding contact surfaces.

18 Claims, 5 Drawing Sheets

GUIDE GROOVE AT BRIDGE SECTIONS OR THE LIKE OF PORTABLE BRIDGES AND METHOD FOR REPAIRING THE SAME

BACKGROUND OF THE INVENTION

1. Field of the Invention

The invention relates to a guide groove bridge sections or the like of portable bridges and method for repairing the same.

2. Description of the Related Art

Such guide grooves, mainly in the form of U-shaped profile sections, are disposed underneath portable bridges on the inside of the track supports or track paths of bridge sections (see, for example, DE-AS 16 58 623, FIG. 4), on front part supports (see DE 31 38 853 A1, FIG. 2) and center supports (see DE 39 14 441 A1, FIG. 1). Guide rollers of a placement device, in particular a placement arm (DE-AS 16 58 623) or a bridge section (DE 31 38 853 A1), engage these guide grooves in order to be able to hold the bridge sections having the guide grooves, to support them while they are being pushed forward or to place them on a bridge constructed by means of other bridge sections.

For the static stabilization of a bridge section it is further known to provide the inner lower chord of the track supports with a torsion-proof cross section and to integrate the guide groove in this cross section (see, for example, DE 41 23 092 A1, FIG. 3).

The support rollers are in their extreme load position shortly before laying a bridge down, when the bridge to be moved is held horizontally freely projecting above the obstacle, for example a river, and the guide groove is under a correspondingly great strain. The guide groove can be damaged because of wrong manipulation or wrong adjustment of the bridge sections in respect to each other. Since the guide groove is a component of a cross section of a welded lower chord, in case of damage the guide grooves can only be removed with an unacceptably great effort to be replaced by new ones. In the course of removal it is possible that previously contained weld stresses can lead to the warping of at least parts of the lower chord, which brings further complications during repair.

It is the object of the invention to improve a guide groove of the previously mentioned type in such a way that its service life is increased and that, in case of need, repairs can be made without problems.

SUMMARY OF THE INVENTION

This object is attained in accordance with the invention for one in that the vertical wall arrangement around the center of the bridge section has a reduced cross section over a partial length of the bridge section in respect to at least one end of the bridge section and in particular is narrower, in order to keep the bridge structure as light as possible.

The cross section reduction, by machining as a rule, results in a remaining cross section which corresponds to the cross section of the vertical wall arrangement of conventional bridge sections. This means that the vertical wall arrangement has, on at least one end of the bridge section, a cross section which is thicker than in conventional bridge sections.

The greatest cross section therefore is in the end area of a bridge section, for example, embodied as a ramp section, in which the greatest stresses occur when the entire bridge must be supported while freely projecting, so that the danger of damage is reduced and the service life of the guide groove is accordingly extended.

In accordance with a further development of the attainment of the object of the invention, over a partial length of the bridge section with the cross section of the vertical wall arrangement not reduced, the lower wall section and—with reference this partial length—a part of the vertical wall arrangement is formed by an insertion element which can be releasably fastened, which essentially is designed as an L-shaped angled profile section, wherein one leg of the angled profile section is releasably fastened on the homogeneous material of the vertical wall arrangement and the other leg forms the lower wall section, and wherein the homogeneous material of the vertical wall arrangement has a contact surface and the insertion element has a corresponding contact surface.

The insertion element can be limited to the smallest possible dimensions, because a lateral limitation of the guide groove (in the case of lower chord profile sections the upper lateral limit facing the track) is made more solid or is supported.

In case of damage to the guide groove and in particular the lower wall section it is possible to remove, in particular by machining, a portion of the thicker (non-reduced) part of the cross section while forming a contact surface, and the guide groove can be newly formed by the simple insertion and fastening of the insertion element.

On the other hand, the object is also attained by the invention in that, already in the delivered state of a bridge section, at least over a partial length thereof the lower wall section and a portion of the vertical wall arrangement are formed by an insertion element which can be releasably fastened and essentially is designed as an L-shaped angled profile section, wherein one leg of the angled profile section is releasably fastened on the homogeneous material of the vertical wall arrangement and the other leg forms the lower wall section, and wherein the homogeneous material of the vertical wall arrangement has a contact surface and the insertion element has a corresponding contact surface.

In this case the vertical wall arrangement consisting of a homogeneous material can have a constant thickness, wherein it is only necessary to reduce the lower wall section of the possibly extruded material for fastening the insertion element over the partial length required for this.

Since the insertion element can be made of a high-strength material, it is possible to calculate the service life correspondingly high.

In case of repair it is only necessary to remove the destroyed insertion element and to replace it with a new one.

Advantageous further developments of both attainments of the object in accordance with the invention are recited in the dependent claims. In a preferred embodiment the releasable insertion element is fastened by means of a screw connection on the bridge section and as a rule on its lower chord profile section.

To keep the considerable shear forces generated during the projecting support of the bridge away from the screw connection, it is further proposed to fasten the releasable insertion element on the bridge section in a positive manner which, in a preferred embodiment, has the form of a shoulder. However, the positive closure can also be achieved by dowel pins or the like. The insertion element is preferably fastened on the strip of an extruded profile section, wherein the guide groove is formed directly by the extruded profile section itself over the greater partial length of the bridge section not covered by the insertion element.

To make the bridge construction as light as possible it is furthermore provided that the strip over the partial length not covered by the insertion element is reduced in cross section by means of machining or the like.

In a further embodiment of the invention the strip is an integral component of a torsion-resistant hollow profile section which is possibly made from an I-shaped extruded profile section by welding in a strip on the side facing away from the guide groove. Finally, the inner lower chord of the track support constitutes a preferred site for disposing the guide groove and accordingly for fastening the insertion element.

The method for repairing a guide groove mentioned at the outset is distinguished in that the vertical wall arrangement is machined on the side forming the guide groove to form a contact surface over at least a portion of the height from the bottom, and that an insertion element, which forms the contour of a wall section of the guide groove, is releasably fastened on the contact surface of the vertical wall arrangement.

BRIEF DESCRIPTION OF THE DRAWINGS

Exemplary embodiments of the invention are represented in the drawings and will be described in detail in what follows. Shown are in.

DESCRIPTION OF THE PREFERRED EMBODIMENTS

Figure 1:
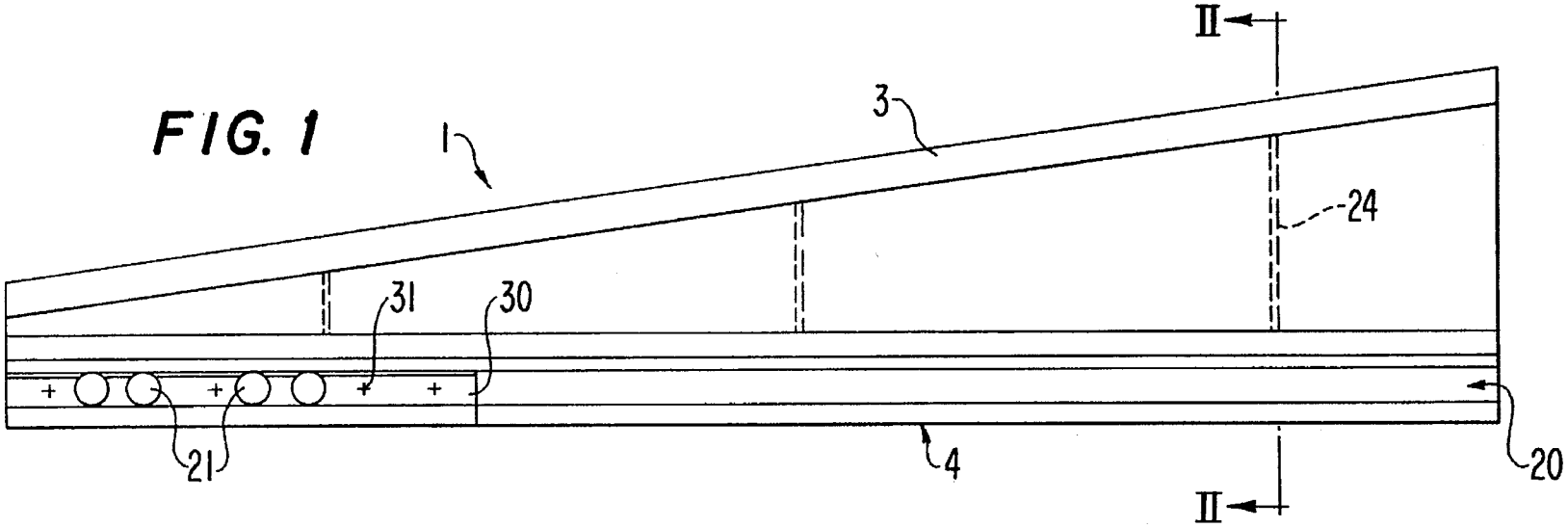
FIG. 1, a bridge section embodied as a ramp section in longitudinal section along the line I—I of FIG. 2, FIG. 2, the bridge section in a cross-sectional view along the lines II—II in FIG. 1, FIG. 3, a lower chord facing the longitudinal center plane of the bridge section in cross-sectional view, FIG. 4, the lower chord profile section prepared for the installation of an insertion element and an insertion element in an exploded cross-sectional representation, FIG. 5, a lower chord profile section in a part of the lower chord not covered by an insertion element in cross-sectional view, FIG. 6, the starting profile section of a lower chord of another embodiment, FIG. 7, the lower chord profile section of FIG. 6, complemented to form a hollow profile section, with an insertion element, FIG. 8, the lower chord profile section, complemented to form a hollow profile section, at the partial length not covered by the insertion element, FIG. 9, the starting profile section of a lower chord of yet another embodiment, and FIG. 10, the lower chord profile section with an insertion element.
Figure 2:
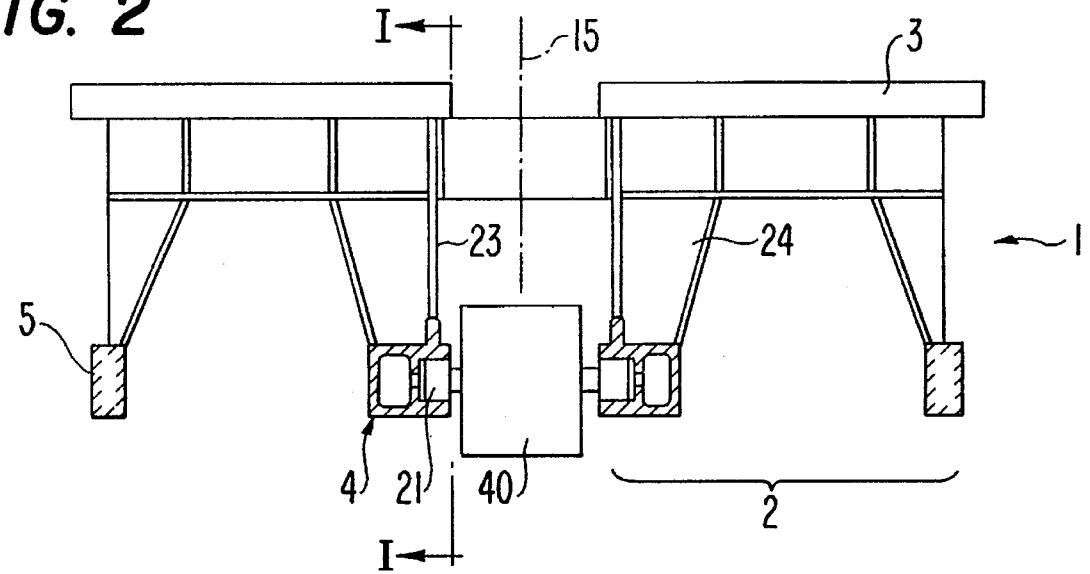

A bridge section 1, embodied as a ramp section which forms one end of a portable bridge, is schematically represented in FIG. 1. In a known manner the bridge section has two track supports 2 with a possibly tiltable driving track 3 and inner and outer lower chords 4 and 5 (see FIG. 2).

Figure 3:
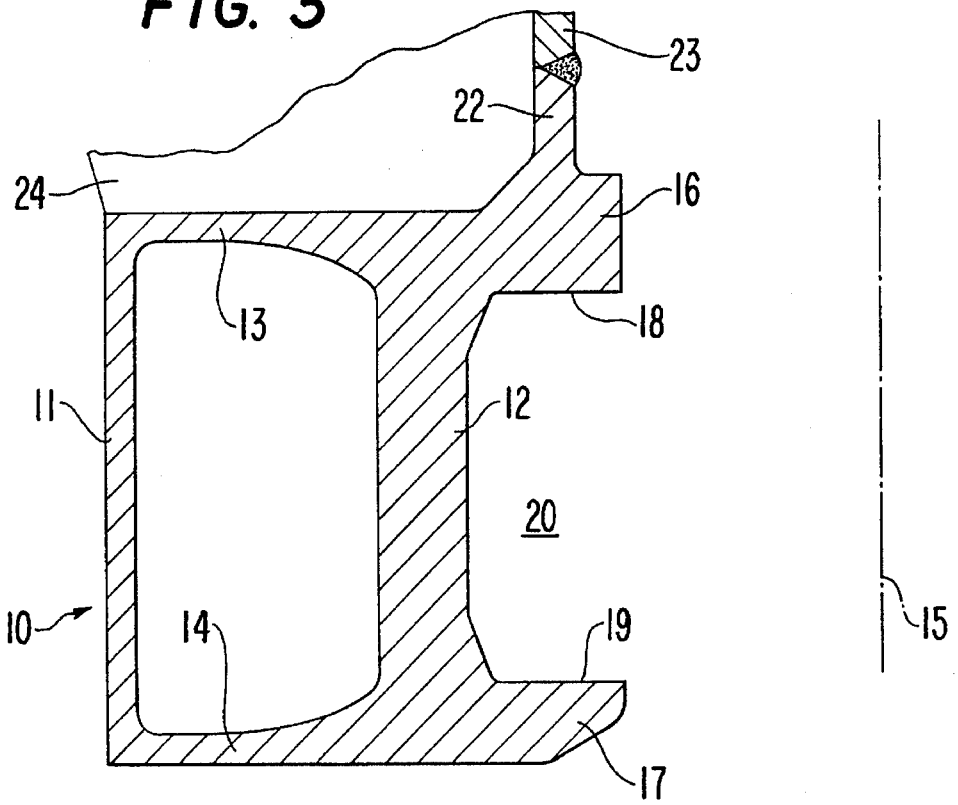

In a first exemplary embodiment, extruded profile section 10 shown in FIG. 3, made of a weldable aluminum alloy, for example AlZn4, 5Mg1, [sic] is used. It has a hollow cross section, closed on itself, with four strips 11 to 14, wherein the two strips 11, 12 are aligned parallel and the two other strips 13, 14 vertically in respect to the longitudinal central plane 15 of the bridge section 1.

Upper and lower wall sections 16, 17 adjoin the strip 12 oriented toward the center vertically in respect to it. In the process, the strip 12 and the two facing surfaces 18, 19 of the wall sections 16, 17 constitute a guide groove 20 (hereinafter only called groove for short) for receiving the support rollers 21 of a placement arm or placement beam 40.

A wall shoulder 22 is disposed above the upper wall section 16 and is welded together with a vertical sheet metal plate 23 of the track support 2. Upper strip 13 is fixedly connected with reinforcing sheet metal plates 24 of the track supports 2, so that the lower chord 4 is embodied to be torsion-resistant.

Vertical strip 12 of the extruded profile section is thicker than is customary. This results in increased sturdiness, so that a break only occurs under a larger load than those on customary bridge sections.

Figure 4:
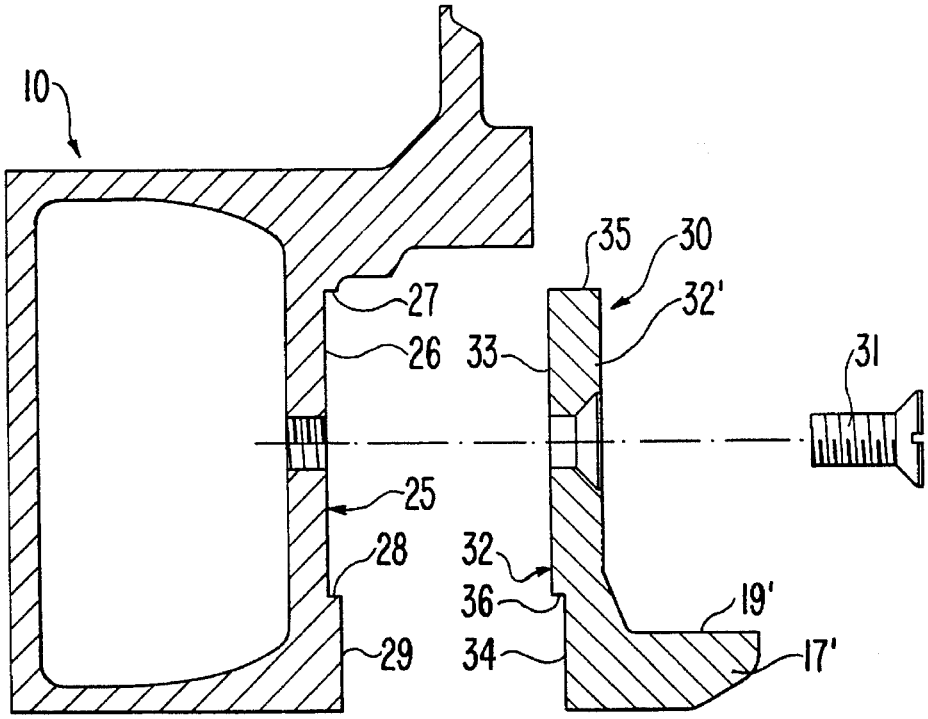

In addition, in case of damage of the lower wall section 17, at this place the thicker design of the strip 12 permits the removal by machining of a partial cross section of the profile section 10 to form the shape shown at the left in FIG. 4. The machined new shape has a recess 25 formed by a contact surface 26 extending parallel to the longitudinal central plane 15 and an upper and a lower shoulder 27 or 28. A further contact surface 29 extending parallel to the longitudinal central plane 15 adjoins the lower shoulder 28. After the repair, an insertion element 30 (hereinafter only called insert for short) is fastened with screw bolts 31 to the partial piece of the profile section 10 machined in the described manner to reconstruct a damaged part of the guide groove 20.

The insert 30 has an essentially L-shaped cross section with a vertical leg 32' and a horizontal leg 17' and has, corresponding to the recess 25 with the surfaces 26, 28 and the shoulders 27, 29, a projection 32 formed by two contact surfaces 33, 34, a lateral surface 35 and a shoulder 36. The leg 17' of the insert 30 corresponds to the wall section 17 of the extruded profile section 10. The upper surface 19' of the wall section or leg 17' corresponds to bearing surface 19 of the groove 20.

The considerable shear forces occurring in the course of laying a bridge—in particular if the bridge is held projectingly by a laying device (see for example DE 40 22 641 C2, FIG. 1)—are directed via the pair of shoulders 28/36, so that the bolted connection formed by screw bolts 31 is relieved of the shear forces. Since no welded connection is provided for it, the insert 30 can be made of high-strength steel, for example 42CrMo4 [sic], or of a high-strength non-weldable copper-containing aluminum alloy.

Figure 5:
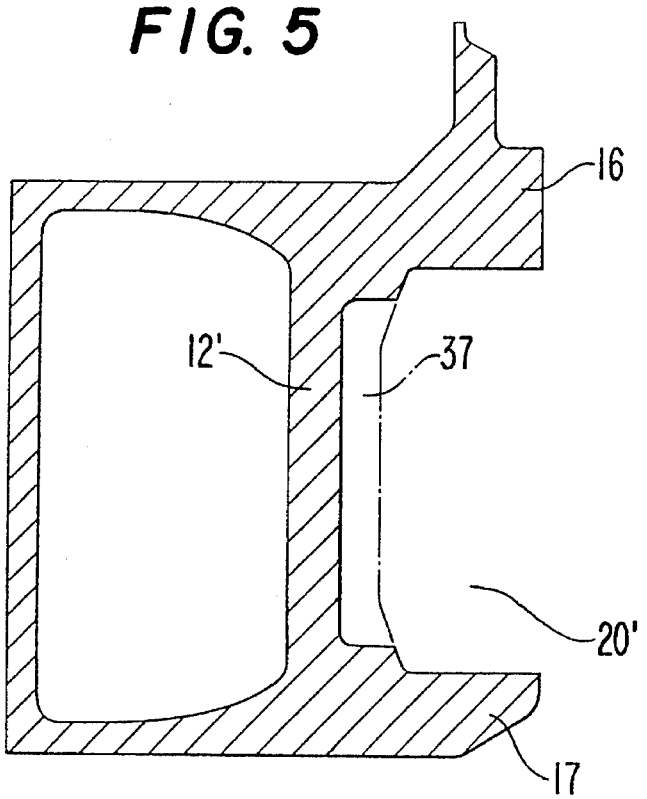

To make the bridge sections 1 as light as possible, the cross section of the extruded profile section 10 is weakened over the length not intended for installing an insert: in contrast to the cross section shown in FIG. 3, the vertical strip 12 is cut by machining at the side of the groove 20. FIG. 5 shows this cross section with the narrower strip 12' and the groove 20' enlarged around the cut cross-sectional surface 37.

Figure 6:
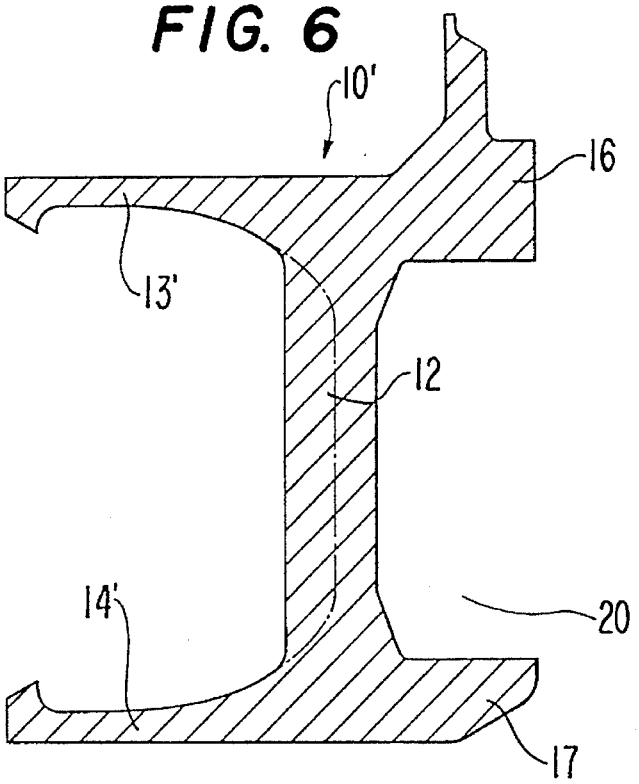
Figure 7:
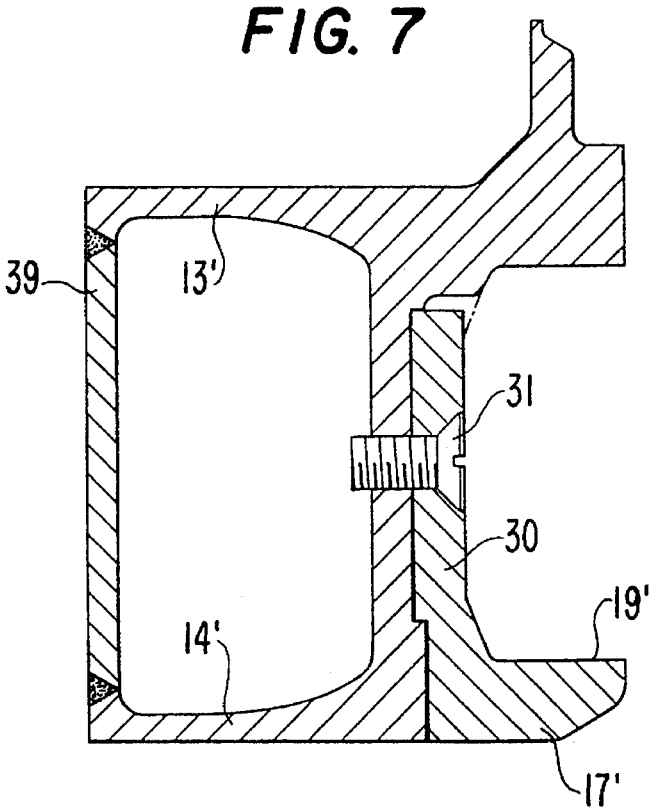
Figure 9:
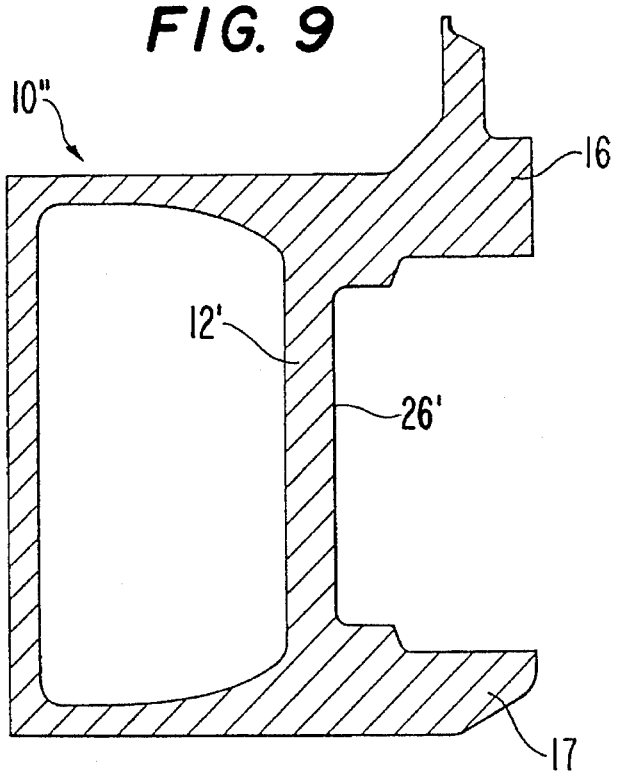

In another exemplary embodiment an extruded I-profile section is employed for the lower chord of the track supports 2, which is represented in FIG. 6. The strip 12 and the groove 20 are designed corresponding to the cross section shown in FIG. 3. However, the strip 12 and the strips 12', 14' pointing away from the guide groove 20 form an open profile and are initially not connected via a further wall element into a hollow profile section.

At the highly stressed ends of the bridge section 1, the groove 20 is designed the same as in the exemplary embodiments of FIGS. 3 and 4.

Figure 8:
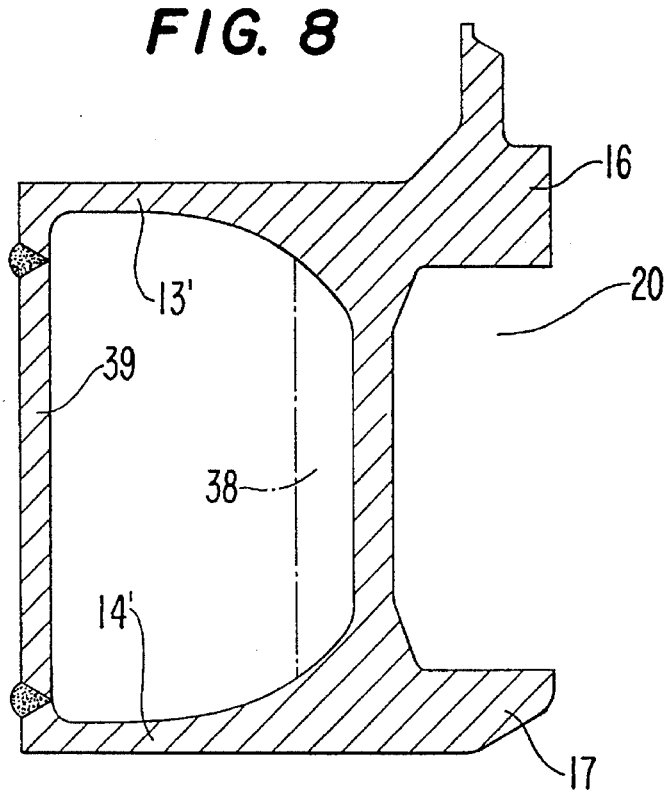

To reduce the weight of the lower chord, the strip 12 is reduced by machining, on the side facing away from the groove 20, by the amount of the partial cross-sectional surface (see FIG. 8) over the large partial length of the guide groove 20 which is not highly stressed. To make a torsion-resistant cross section, a wall section 39 is subsequently welded between the two strips 13', 14'.

The embodiment of the bridge section 1 is not limited to the form of a ramp section, instead, the bridge section can also be designed as a universally usable bridge section which selectively can be used as a ramp section as well as a center section (see, for example, DE 39 11 266 A1 which corresponds to U.S. Pat. No. 5,063,630).

Figure 10:
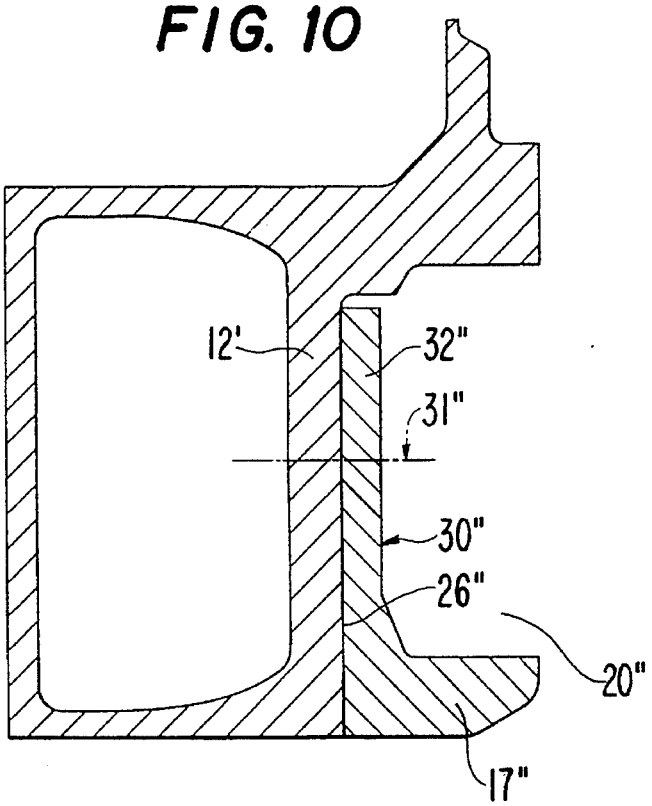

A further exemplary embodiment having an extruded profile section 9" is represented in FIG. 10 which, after reducing the partial cross section 37, corresponds to the cross section shown in FIG. 5. If necessary, the wall section is already cut down prior to delivery of the associated bridge section, and the vertical surface 26' of the strip 12' is increased to form a contact surface 26". An insertion element 30" (see FIG. 10) is bolted to this contact surface 26" at 31" with its upper leg 32" against the contact surface 26" of the leg 12'. The insert 30" has a further horizontal leg 17" to form a guide groove 20".

What is claimed is:

1. A guide groove provided in a bridge section of a portable bridge, the bridge section having a length, a center portion, and end portions, comprising:

a vertical strip having an upper end and a lower end, and being comprised of, over its entire height in at least a partial cross section thereof, a homogeneous material; and an upper wall section extending from the upper end of the vertical strip and a lower wall section extending from the lower end of the vertical strip, wherein the vertical strip has a thickness in cross section which is reduced at the center portion of the bridge section over at least a part of the length of the bridge section compared to at least one of the end portions of the bridge section.

2. The guide groove according to claim 1, wherein the vertical strip, the upper wall section, and the lower wall section which define the guide groove are comprised of a homogeneous material which is extruded in at least a partial cross section thereof.

3. A guide groove provided in a bridge section of a portable bridge, the bridge section having a length, a center portion, and end portions, comprising:

a vertical strip having an upper end and a lower end, and being comprised of, over its entire height in at least a partial cross section thereof, a homogeneous material; and an upper wall section extending from the upper end of the vertical strip and a lower wall section extending from the lower end of the vertical strip, wherein the vertical strip has a thickness in cross section which is reduced at the center portion of the bridge section over at least a part of the length of the bridge section in respect to at least one of the end portions of the bridge section, wherein, over a part of the length of the bridge section in which the thickness in cross section of the vertical strip is not reduced, an insertion element is provided having an L-shaped profile including a horizontal leg which comprises the lower wall section and a vertical leg which comprises a part of the vertical strip, which vertical leg of the insertion element can be releasably fastened to the vertical strip, and wherein the vertical strip has at least one contact surface and the vertical leg of the insertion element has a corresponding at least one contact surface.

4. The guide groove in accordance with claim 3, wherein the insertion element is releasably fastened by a screw connection.

5. The guide groove in accordance with claim 3, wherein the insertion element is fastened to the vertical strip by means including a positive closure acting toward the lower wall section.

6. The guide groove in accordance with claim 5, wherein the at least one contact surface of the vertical strip includes a shoulder, wherein the at least one contact surface of the vertical leg of the insertion element includes a shoulder which matingly engages the shoulder of the at least one contact surface of the vertical strip, and wherein the positive closure is provided by the mating engagement of the shoulders.

7. The guide groove in accordance with claim 3, further comprising an extruded profile section which includes the vertical strip, and wherein the insertion element is fastened on at least one contact surface of the vertical strip, and wherein the guide groove, over the partial length of the bridge section not covered by the insertion element, consists of the extruded profile section.

8. The guide groove in accordance with claim 7, wherein the vertical strip, over the partial length of the bridge section not covered by the insertion element, consists of the extruded profile section.

9. The guide groove in accordance with claim 7, wherein the vertical strip has a face which faces away from the guide groove, and wherein the face of the vertical strip which faces away from the guide groove has, in the partial length of the bridge section not covered by the insertion element, a reduction in cross section provided by a machining operation.

10. The guide groove in accordance with claim 7, wherein the extruded profile section is hollow and is torsion-resistant.

11. The guide groove in accordance with claim 3, wherein the bridge section includes an inner lower chord, and wherein the insertion element is releasably fastened to the inner lower chord of the bridge section.

12. The guide groove according to claim 3, wherein the vertical strip, the upper wall section, and the lower wall section which define the guide groove are comprised of a homogeneous material which is extruded in at least a partial cross section thereof.

13. The guide groove according to claim 3, wherein the at least one contact surface of the vertical strip is machined.

14. A guide groove provided in a bridge section of a portable bridge, the bridge section having a length, a center portion, and end portions, comprising:

a vertical strip having an upper end and a lower end, and being comprised of, over its entire height in at least a partial cross section thereof, a homogeneous material; and an upper wall section extending from the upper end of the vertical strip and a lower wall section extending from the lower end of the vertical strip, wherein, over a part of the length of the bridge section, an insertion element is provided having an L-shaped profile including a horizontal leg which comprises the lower wall section and a vertical leg which comprises a part of the vertical strip, which vertical leg of the insertion element can be releasably fastened to the vertical strip, and wherein the vertical strip has at least one contact surface and the vertical leg of the insertion element has a corresponding at least one contact surface.

15. The guide groove according to claim 14, wherein the vertical strip, the upper wall section, and the lower wall section which define the guide groove are comprised of a homogeneous material which is extruded in at least a partial cross section thereof.

16. The guide groove according to claim 14, wherein the at least one contact surface of the vertical strip is machined.

17. A method for repairing a guide groove provided in a bridge section of a portable bridge, the bridge section having a length, a center portion, and end portions, in which the guide groove defined by a vertical strip having an upper end and a lower end, and being comprised of, over its entire height in at least a partial cross section thereof, a homogeneous material; and an upper wall section extending from the upper end of the vertical strip and a lower wall section extending from the lower end of the vertical strip, wherein the vertical strip has a thickness in cross section which is reduced at the center portion of the bridge section over at least a part of the length of the bridge section in respect to at least one of the end portions of the bridge section, wherein, over a part of the length of the bridge section in which the thickness in cross section of the vertical strip is not reduced, an insertion element is provided having an L-shaped profile including a horizontal leg which comprises the lower wall section and a vertical leg which comprises a part of the vertical strip, which vertical leg of the insertion element can be releasably fastened to the vertical strip, and wherein the vertical strip has at least one contact surface and the vertical leg of the insertion element has a corresponding at least one contact surface, the method comprising:

removing the releasably fastened insertion element; and replacing the removed insertion element with a new insertion element.

18. The method according to claim 17, wherein the vertical strip, the upper wall section, and the lower wall section which define the guide groove are comprised of a homogeneous material which is extruded in at least a partial cross section thereof.

* * * * *